US011060046B2

(12) United States Patent
Shinoda

(10) Patent No.: US 11,060,046 B2
(45) Date of Patent: Jul. 13, 2021

(54) LUBRICATING OIL COMPOSITION

(71) Applicant: IDEMITSU KOSAN CO., LTD., Chiyoda-ku (JP)

(72) Inventor: Jitsuo Shinoda, Sodegaura (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 15/559,674

(22) PCT Filed: Mar. 18, 2016

(86) PCT No.: PCT/JP2016/058635
§ 371 (c)(1),
(2) Date: Sep. 19, 2017

(87) PCT Pub. No.: WO2016/152752
PCT Pub. Date: Sep. 29, 2016

(65) Prior Publication Data

US 2018/0282655 A1 Oct. 4, 2018

(30) Foreign Application Priority Data

Mar. 20, 2015 (JP) ..... JP2015-058362

(51) Int. Cl.

| | |
|---|---|
| ***C10N 40/00*** | (2006.01) |
| ***C10N 70/00*** | (2006.01) |
| ***C10M 169/04*** | (2006.01) |
| ***C10M 141/06*** | (2006.01) |
| ***C10M 141/02*** | (2006.01) |
| ***C10M 129/10*** | (2006.01) |
| ***C10M 129/34*** | (2006.01) |
| ***C10M 129/54*** | (2006.01) |
| ***C10M 129/95*** | (2006.01) |
| ***C10M 133/12*** | (2006.01) |
| ***C10M 133/44*** | (2006.01) |
| ***C10M 137/04*** | (2006.01) |

(Continued)

(52) U.S. Cl.

CPC ..... *C10M 169/04* (2013.01); *C10M 129/10* (2013.01); *C10M 129/34* (2013.01); *C10M 129/54* (2013.01); *C10M 129/95* (2013.01); *C10M 133/12* (2013.01); *C10M 133/44* (2013.01); *C10M 137/04* (2013.01); *C10M 141/02* (2013.01); *C10M 141/06* (2013.01); *C10M 141/10* (2013.01); *C10M 2203/003* (2013.01); *C10M 2203/1025* (2013.01); *C10M 2207/026* (2013.01); *C10M 2207/044* (2013.01); *C10M 2207/046* (2013.01); *C10M 2207/123* (2013.01); *C10M 2207/126* (2013.01); *C10M 2207/282* (2013.01); *C10M 2207/283* (2013.01); *C10M 2207/289* (2013.01); *C10M 2207/34* (2013.01); *C10M 2215/065* (2013.01); *C10M 2215/223* (2013.01); *C10M 2215/26* (2013.01); *C10M 2215/30* (2013.01); *C10M 2223/04* (2013.01); *C10M 2223/041* (2013.01); *C10M 2223/043* (2013.01); *C10M 2223/047* (2013.01); *C10N 2030/02* (2013.01); *C10N 2030/06* (2013.01); *C10N 2030/10* (2013.01); *C10N 2040/02* (2013.01); *C10N 2040/04* (2013.01); *C10N 2040/08* (2013.01); *C10N 2040/12* (2013.01); *C10N 2040/135* (2020.05); *C10N 2040/25* (2013.01); *C10N 2040/30* (2013.01); *C10N 2070/00* (2013.01)

(58) Field of Classification Search

CPC ..... C10M 129/10; C10M 141/02; C10M 141/06; C10M 141/10; C10M 169/04; C10M 2203/003; C10M 2203/1025; C10M 2207/026; C10M 2207/044; C10M 2207/046; C10M 2207/123; C10M 2207/126; C10M 2207/282; C10M 2207/283; C10M 2207/289; C10M 2207/34; C10M 2215/065; C10M 2215/223; C10M 2215/26; C10M 2215/30; C10M 2223/04; C10M 2223/041; C10M 2223/043; C10M 2223/047; C10N 2030/02; C10N 2030/06; C10N 2030/10; C10N 2040/02; C10N 2040/04; C10N 2040/08; C10N 2040/12; C10N 2040/135; C10N 2040/25; C10N 2040/30; C10N 2070/00

See application file for complete search history.

(56) References Cited

U.S. PATENT DOCUMENTS 4,101,031 A * 7/1978 Cromie ..... A61F 2/0095 206/438
4,101,431 A 7/1978 Kuntschik
(Continued)

FOREIGN PATENT DOCUMENTS

CN 1100859 C 2/2003
CN 102766508 A 11/2012
(Continued)

OTHER PUBLICATIONS

Extended European Search Report dated Jul. 9, 2018 in European Patent Application No. 16768655.9, 7 pages.
(Continued)

*Primary Examiner* — James C Goloboy
(74) *Attorney, Agent, or Firm* — Oblon, McClelland, Maier & Neustadt, L.L.P.

(57) ABSTRACT

The lubricating oil composition of the present invention contains a base oil, a 2,6-di-tert-butylphenol (A), and at least one compound (B) selected from a benzotriazole compound and a sorbitan compound.

12 Claims, No Drawings

(51) Int. Cl.

| | |
|---|---|
| ***C10M 141/10*** | (2006.01) |
| ***C10N 30/02*** | (2006.01) |
| ***C10N 30/06*** | (2006.01) |
| ***C10N 30/10*** | (2006.01) |
| ***C10N 40/02*** | (2006.01) |
| ***C10N 40/04*** | (2006.01) |
| ***C10N 40/08*** | (2006.01) |
| ***C10N 40/12*** | (2006.01) |
| ***C10N 40/25*** | (2006.01) |
| ***C10N 40/30*** | (2006.01) |

(56) References Cited

U.S. PATENT DOCUMENTS

| | | | | |
|---|---|---|---|---|
| 5,080,815 | A * | 1/1992 | Fenoglio | C07D 249/14 508/190 |
| 5,356,547 | A | 10/1994 | Arai et al. | |
| 5,364,545 | A * | 11/1994 | Arai | C10M 141/10 508/365 |
| 5,580,482 | A | 12/1996 | Chasan et al. | |
| 5,922,656 | A | 7/1999 | Yoshimura et al. | |
| 6,326,336 | B1 | 12/2001 | Gatto et al. | |
| 6,410,490 | B1 | 6/2002 | Reyes-Gavilan et al. | |
| 2005/0202979 | A1* | 9/2005 | Henly | C10M 141/10 508/192 |
| 2009/0116771 | A1* | 5/2009 | Kamimura | C10M 107/02 384/100 |
| 2010/0009882 | A1* | 1/2010 | Ito | C10M 129/10 508/465 |
| 2010/0210487 | A1* | 8/2010 | Deblase | C10M 129/02 508/100 |
| 2012/0101015 | A1* | 4/2012 | Frapin | C10M 169/04 508/282 |
| 2012/0108477 | A1* | 5/2012 | Tobias | C10M 163/00 508/287 |
| 2013/0310289 | A1* | 11/2013 | Umehara | C10M 135/18 508/363 |

FOREIGN PATENT DOCUMENTS

| | | | |
|---|---|---|---|
| CN | 103666656 | A | 3/2014 |
| EP | 0 239 536 | A2 | 9/1987 |
| JP | 53-139603 | A | 12/1978 |
| JP | 62-270697 | A | 11/1987 |
| JP | 5-186787 | A | 7/1993 |
| JP | 7-150167 | A | 6/1995 |
| JP | 7-228882 | A | 8/1995 |
| JP | 7-258677 | A | 10/1995 |
| JP | 8-231976 | A | 9/1996 |
| JP | 9-176672 | A | 7/1997 |
| JP | 10-265793 | A | 10/1998 |
| JP | 11-199887 | A | 7/1999 |
| JP | 2000-119675 | A | 4/2000 |
| JP | 2000-351984 | A | 12/2000 |
| JP | 2004-339324 | A | 12/2004 |
| JP | 2005-36194 | A | 2/2005 |
| JP | 2005-239897 | A | 9/2005 |
| JP | 2009-292997 | A | 12/2009 |

OTHER PUBLICATIONS

International Search Report dated Jun. 14, 2016 in PCT/JP2016/058635 filed Mar. 18, 2016.

Japanese Office Action dated Jan. 8, 2019 in Patent Application No. 2015-058362 (with English translation), 16 pages.

Office Action dated Jul. 12, 2019, in European Patent Application No. 16768655.9, filed Mar. 18, 2016.

Japanese Office Action dated Oct. 23, 2019, in Patent Application No. 2015-58362, 7 pages (with unedited computer generated English translation).

European Office Action dated Feb. 12, 2020 in European Patent Application No. 16 768 655.9, 6 pages.

Office Action in ID Application No. P00201706382, dated Apr. 16, 2020.

Combined Chinese Office Action and Search Report dated Mar. 6, 2020, in Patent Application No. 201680016926.7 (with English translation), 19 pages.

Chinese Office Action dated Sep. 22, 2020 in Chinese Patent Application No. 201680016926.7 (with English language translation), 14 pages.

* cited by examiner

LUBRICATING OIL COMPOSITION

CROSS-REFERENCE TO RELATED APPLICATIONS

This application is a National Stage of PCT/JP2016/058635, which was filed on Mar. 18, 2016. This application is based upon and claims the benefit of priority to Japanese Application No. 2015-058362, which was filed on Mar. 20, 2015.

TECHNICAL FIELD

The present invention relates to a lubricating oil composition, and relates to, for example, a lubricating oil composition for use as a turbine oil.

BACKGROUND ART

A lubricating oil is often required to have a prolonged lifetime so as to be used for a long period of time while having stable performance. For example, a turbine oil is much used in power plants, and when power plants stop owing to degradation of lubricating oil therein, they may exert serious influences and therefore lifetime prolongation is an important issue for them.

Heretofore, an antioxidant such as a phenol-based antioxidant, an amine-based antioxidant or the like is blended in a lubricating oil such as a turbine oil or the like for enhancing oxidation stability to attain lifetime prolongation. Here, as a phenol-based antioxidant, a hindered phenol-based one such as 2,6-di-tert-butyl-p-cresol or the like is used. As an amine-based antioxidant, an alkylated diphenylamine, an alkylated phenyl-α-naphthylamine or the like is used.

In addition, any other additive than antioxidant may be blended in a turbine oil for improving oxidation stability and for obtaining any other effects. For example, PTLs 1 and 2 disclose a turbine oil added with a phosphorus-containing extreme pressure agent such as a phosphite or the like, in addition to an alkylated diphenylamine and an alkylated phenyl-α-naphthylamine. PTL 3 discloses a turbine oil blended with a phosphite, an alkylsuccinic acid derivative and a benzotriazole compound in addition to an alkylated phenyl-α-naphthylamine. Further, PTL 4 discloses a turbine oil composition blended with a benzotriazole compound as well as a phenol-based antioxidant such as 2,6-di-tert-butyl-p-cresol.

CITATION LIST

Patent Literature

PTL 1: JP 7-228882 A
PTL 2: JP 2005-239897 A
PTL 3: JP 7-258677 A
PTL 4: JP 11-199887 A

SUMMARY OF INVENTION

Technical Problem

However, the turbine oils disclosed in PTLs 1 to 4 have limitations in improving the oxidation stability thereof, and lifetime prolongation required for turbine oils is not always attained. In addition, for improving oxidation stability, increasing the amount of the antioxidant to be added may be taken into consideration, but even though the amount of the phenol-based antioxidant to be added is increased, there is still limits on improving oxidation stability. On the other hand, regarding an amine-based antioxidant, when the amount thereof to be added is increased, oxidation stability could be improved relatively, but much sludge derived from the additive forms, therefore providing a problem in that substantial use thereof is impossible.

The present invention has been made in consideration of the above-mentioned problems, and an object of the present invention is to provide a lubricating oil composition having improved oxidation stability while suppressing sludge formation.

Solution to Problem

As a result of assiduous studies, the present inventors have found that, by blending a benzotriazole compound or a sorbitan compound along with a specific phenol-based antioxidant, the oxidation stability of a lubricating oil composition can be improved, and have completed the following present invention.

(1) A lubricating oil composition containing a base oil, a 2,6-di-tert-butylphenol (A), and at least one compound (B) selected from a benzotriazole compound and a sorbitan compound.

(2) A method for producing a lubricating oil composition, including blending a base oil with a 2,6-di-tert-butylphenol (A) and at least one compound (B) selected from a benzotriazole compound and a sorbitan compound to obtain a lubricating oil composition.

Advantageous Effects of Invention

In the present invention, there can be provided a lubricating oil composition having improved oxidation stability while suppressing sludge formation.

DESCRIPTION OF EMBODIMENTS

Hereinunder the present invention is described with reference to embodiments thereof.

The lubricating oil composition of one aspect of the present invention contains a base oil, a 2,6-di-tert-butylphenol (DTBP) (hereinunder this may be referred to as "compound (A)"), and at least one compound selected from a benzotriazole compound and a sorbitan compound (hereinunder this may be referred to as "compound (B)").

Hereinunder the components contained in the lubricating oil composition are described in more detail.

[Base Oil]

The base oil is not specifically limited, and any one adequately selected from mineral oils and synthetic oils can be used, but mineral oils are preferably used.

Examples of mineral oils include mineral oils prepared by distilling crude oil through normal pressure distillation to obtain a normal pressure bottom oil, distilling the normal pressure bottom oil through reduced pressure distillation to obtain a lubricating oil fraction and refining the lubricating oil fraction through at least one treatment of solvent deasphalting, solvent extraction, hydrogenation cracking, solvent dewaxing, catalytic dewaxing, hydrogenation refining or the like, and among these, mineral oils prepared by refining through hydrogenation refining treatment are preferred.

Mineral oils are grouped in any of Groups 1, 2 and 3 in the base oil category of API (American Petroleum Institute), and from the viewpoint of preventing sludge formation, those grouped in Groups 2 and 3 are preferred. In addition, for more bettering oxidation stability, those grouped in Group 3 are more preferred. The base oils grouped in Group 1 have a saturation fraction of less than 90% and/or a sulfur content of more than 0.03%, and have a viscosity index of 80 or more and less than 120. The base oils grouped in Group 2 have a saturation fraction of 90% or more and a sulfur content of 0.03% or less, and have a viscosity index of 80 or more and less than 120. The base oils grouped in Group 3 have a saturation fraction of 90% or more and a sulfur content of 0.03 or less, and have a viscosity index of 120 or more.

The sulfur content is a value measured according to JIS K 2541, and the saturation fraction is a value measured according to ASTM D 2007. Further, the viscosity index is a value measured according to JIS K 2283.

Examples of synthetic oils include polyolefins such as polybutenes, α-olefin homopolymers, ethylene-α-olefin copolymers, etc.; various esters such as polyol esters, dibasic acid esters, etc.; various ethers such as polyphenyl ethers, etc.; and polyglycols, alkylbenzenes, alkylnaphthalenes, etc.

In this aspect, as the base oil, one alone or two or more kinds of mineral oils may be used either singly or as combined. Also one alone or two or more kinds of synthetic oils may be used either singly or as combined. Further, one or more kinds of mineral oils and one or more kinds of synthetic oils may be used as combined.

The base oil is to be the main component in the lubricating oil composition, and is contained in the composition generally in an amount of 70% by mass or more relative to the total amount of the lubricating oil composition, preferably 80 to 99.7% by mass, more preferably 90 to 99.6% by mass.

[Compound (A)]

In this aspect, as mentioned above, 2,6-di-tert-butylphenol (DTBP) is used as a phenol-based antioxidant. In this aspect, the specific antioxidant is used along with a benzotriazole compound or a sorbitan compound to be described below, thereby realizing significant improvement of oxidation stability.

Preferably, DTBP is contained in an amount of 0.1 to 5.0% by mass based on the total amount of the lubricating oil composition. When the content of DTBP is 0.1% by mass or more, oxidation stability can be sufficiently improved. On the other hand, the content of 5.0% by mass or less could realize the effect to match it. From these viewpoints, DTBP is contained preferably in an amount of 0.15 to 3.0% by mass based on the total amount of the lubricating oil composition, more preferably 0.2 to 1.0% by mass.

The lubricating oil composition may contain any other phenol-based antioxidant than the above-mentioned DTBP. The other phenol-based antioxidant includes 2,6-di-t-butyl-4-alkylphenols in which the alkyl has 1 to 4 carbon atoms; alkyl-3-(3,5-di-t-butyl-4-hydroxyphenyl)propionates in which the alkyl has 4 to 20 carbon atoms; bisphenol-based antioxidants, etc.

Here, specific examples of 2,6-di-t-butyl-4-alkylphenols include 2,6-di-t-butyl-4-methylphenol, 2,6-di-t-butyl-4-ethylphenol, etc.

Specific examples of alkyl-3-(3,5-di-t-butyl-4-hydroxyphenyl)propionates include octyl-3-(3,5-di-t-butyl-4-hydroxyphenyl)propionate, 6-methylheptyl-3-(3,5-di-t-butyl-4-hydroxyphenyl)propionate, n-octadecyl-3-(3,5-di-t-butyl-4-hydroxyphenyl)propionate.

Further, specific examples of bisphenol-based antioxidants include 4,4'-methylenebis(2,6-di-t-butylphenol), 4,4'-bis(2,6-di-t-butylphenol), 4,4'-bis(2-methyl-6-t-butylphenol), 2,2'-methylenebis(4-ethyl-6-t-butylphenol), 2,2'-methylenebis(4-methyl-6-t-butylphenol), 4,4'-butylidenebis(3-methyl-6-t-butylphenol), 4,4'-isopropylidenebis(2,6-di-t-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 4,4'-thiobis(2-methyl-6-t-butylphenol), 4,4'-thiobis(3-methyl-6-t-butylphenol), 2,2'-thiobis(4-methyl-6-t-butylphenol), bis(3-methyl-4-hydroxy-5-t-butylbenzyl) sulfide, bis(3,5-di-t-butyl-4-hydroxybenzyl) sulfide, thiodiethylenebis[3-(3,5-di-t-butyl-4-hydroxyphenyl)propionate], etc.

Among these, from the viewpoint of oxidation stability, as the other phenol-based antioxidant than DTBP, alkyl-3-(3,5-di-t-butyl-4-hydroxyphenyl)propionates where the alkyl has 4 to 20 carbon atoms are preferred; and among these, alkyl-3-(3,5-di-t-butyl-4-hydroxyphenyl)propionates where the alkyl has 6 to 18 carbon atoms are more preferred; and octyl-3-(3,5-di-t-butyl-4-hydroxyphenyl)propionate is even more preferred.

The other phenol-based antioxidant than DTBP is contained preferably in an amount of 0.1 to 3.0% by mass based on the total amount of the lubricating oil composition, more preferably in an amount of 0.15 to 2.0% by mass, even more preferably 0.2 to 1.0% by mass.

[Compound (B)]

In this aspect, a benzotriazole compound, a sorbitan compound or a mixture thereof is used as the compound (B).

(Benzotriazole Compound)

As the benzotriazole compound for use as the compound (B), benzotriazole or a derivative thereof is exemplified. Specifically, benzotriazole is 1,2,3-benzotriazole represented by the general formula (B-1). Derivatives of benzotriazole include alkylbenzotriazoles represented by the following general formula (B-2), and aminoalkylbenzotriazoles represented by the general formula (B-3). Among these, aminoalkylbenzotriazoles represented by the general formula (B-3) are preferred.

(B-1)

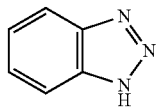

(B-2)

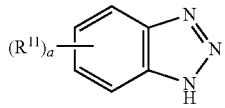

(B-3)

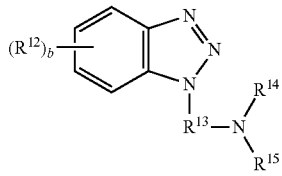

In the formula (B-2), $R^{11}$ represents a linear or branched alkyl group having 1 to 4 carbon atoms, a represents an integer of 1 to 3. Plural $R^{11}$'s, if any, may be the same as or different from each other. Specifically, $R^{11}$ includes a methyl group, an ethyl group, an n-propyl group, an isopropyl group, an n-butyl group, an isobutyl group, a sec-butyl group, a tert-butyl group, etc.

$R^{11}$ is preferably a methyl group or an ethyl group, and a is preferably 1 or 2.

In the general formula (B-3), $R^{12}$ represents a linear or branched alkyl group having 1 to 4 carbon atoms, b represents an integer of 0 to 3, $R^{13}$ represents a methylene group or an ethylene group, $R^{14}$ and $R^{15}$ each independently represent a hydrogen atom, or a linear or branched alkyl group having 1 to 18 carbon atoms. Plural $R^{12}$'s, if any, may be the same as or different from each other. $R^{14}$ and $R^{15}$ may be the same as or different from each other.

Examples of the alkyl group of $R^{12}$ include a methyl group, an ethyl group, an n-propyl group, an isopropyl group, an n-butyl group, an isobutyl group, a sec-butyl group, a tert-butyl group, etc. Examples of the alkyl group of $R^{14}$ and $R^{15}$ include alkyl groups such as a methyl group, an ethyl group, a propyl group, an isopropyl group, an n-butyl group, an isobutyl group, a sec-butyl group, a tert-butyl group, various pentyl groups, various hexyl groups, various heptyl groups, various octyl groups, various nonyl groups, various decyl groups, various undecyl groups, various dodecyl groups, various tridecyl groups, various tetradecyl groups, various pentadecyl groups, various hexadecyl groups, various heptadecyl groups, various octadecyl groups, and the like. Here, the wording "various" is meant to include linear groups and all other branched chain-like groups of structural isomers thereof, and the same shall apply hereinunder.

$R^{12}$ preferably represents a methyl group or an ethyl group, $R^{14}$ and $R^{15}$ each preferably represent a linear or branched alkyl group having 1 to 12 carbon atoms, and b preferably represents a number of 0 or 1.

The compound represented by the formula (B-3) is, especially from the viewpoint of excellent antioxidant performance, preferably a dialkylaminoalkylbenzotriazole or a dialkylaminoalkyltolyltriazole in which $R^{12}$ is a methyl group, b is 0 or 1, $R^{13}$ is a methylene group or an ethylene group, and $R^{14}$ and $R^{15}$ each are a linear or branched alkyl group having 1 to 12 carbon atoms, or a mixture thereof or the like, and among these is more preferably one where $R^{14}$ and $R^{15}$ each have 4 to 12 carbon atoms.

(Sorbitan Compound)

As the sorbitan compound to be used as the compound (B), a sorbitan fatty acid partial ester where the fatty acid has 10 to 22 carbon atoms is exemplified. Partial ester means an ester where at least one or more hydroxy groups in a polyhydric alcohol are not esterified to remain in the form of a hydroxy group.

The sorbitan fatty acid partial ester is, for example, one to be obtained by reacting an ester of a fatty acid having 10 to 22 carbon atoms and a monoalcohol having 1 to 3 carbon atoms, with at least one of sorbitol and sorbitan.

The fatty acid to be used in the sorbitan compound is preferably one having 12 to 20 carbon atoms. The ester is preferably a monoester where one alone of plural hydroxy groups in one molecule has been esterified.

The fatty acid having 10 to 22 carbon atoms may be a saturated fatty acid or an unsaturated fatty acid, or may be a linear fatty acid or a branched fatty acid. Examples of the fatty acid include saturated fatty acids such as various decanoic acids, various undecanoic acids, various dodecanoic acids, various tridecanoic acids, various tetradecanoic acids, various pentadecanoic acids, various hexadecanoic acids, various heptadecanoic acids, various octadecanoic acids, various nonadecanoic acids, various eicosanoic acids, various heneicosanoic acids, various docosanoic acids, etc.; unsaturated fatty acids such as various decenoic acids, various undecenoic acids, various dodecenoic acids, various tridecenoic acids, various tetradecenoic acids, various pentadecenoic acids, various hexadecenoic acids, various heptadecenoic acids, various octadecenoic acids, various nonadecenoic acids, various eicocenoic acids, various heneicocenoic acids, various docosenoic acids, etc.; or mixtures thereof, etc. Among these, octadecenoic acid is preferred, and especially oleic acid is most preferred.

Preferred specific examples of the sorbitan compound include sorbitan partial esters such as sorbitan monolaurate, sorbitan monoisolaurate, sorbitan dilaurate, sorbitan diisolaurate, sorbitan trilaurate, sorbitan triisolaurate, sorbitan monomyristate, sorbitan monoisomyristate, sorbitan dimyristate, sorbitan diisomyristate, sorbitan trimyristate, sorbitan triisomyristate, sorbitan monopalmitate, sorbitan monoisopalmitate, sorbitan dipalmitate, sorbitan diisopalmitate, sorbitan tripalmitate, sorbitan triisopalmitate, sorbitan monostearate, sorbitan monoisostearate, sorbitan distearate, sorbitan diisostearate, sorbitan tristearate, sorbitan triisostearate, sorbitan monooleate, sorbitan monoisooleate, sorbitan dioleate, sorbitan diisooleate, sorbitan trioleate, sorbitan triisooleate, etc.; or mixtures thereof, etc.

The lubricating oil composition contains a benzotriazole compound or a sorbitan compound in addition to the specific phenol-based antioxidant (DTBP), and can therefore have a remarkably high RPVOT value to be excellent in oxidation stability, while suppressing sludge increase. Further, as containing the compound (B), the composition can have improved rust-preventive performance and corrosion resistance to metals, etc.

In this aspect, for realizing more excellent oxidation stability, the ratio by mass of the compound (B) to the compound (A) (DTBP) (B/A) is preferably 0.002 to 1.0, more preferably 0.003 to 0.5, even more preferably 0.005 to 0.3. By controlling the ratio (B/A) to fall within the above range, the synergistic effect of DTBP and the benzotriazole compound or the sorbitan compound can be exhibited more favorably to further better oxidation stability.

For controlling the ratio (B/A) to fall within the above-mentioned preferred range, the compound (B) is contained preferably in an amount of 0.01 to 0.5% by mass based on the total amount of the lubricating oil composition, more preferably 0.01 to 0.3% by mass, even more preferably 0.02 to 0.2% by mass.

[Phosphorus-Containing Extreme Pressure Agent (C)]

Preferably, the lubricating oil composition further contains a phosphorus-containing extreme pressure agent (C). The phosphorus-containing extreme pressure agent (C) includes at least one selected from a triaryl phosphate, a dithiophosphate, and a phosphate amine salt. In this aspect, by using such a phosphorus-containing extreme pressure agent (C), the oxidation stability and the lubricant performance of the lubricating oil composition can be more readily improved.

(Triaryl Phosphate)

The aryl group in the triaryl phosphate includes a phenyl group, an alkyl-substituted phenyl group in which the alkyl group has 1 to 4 carbon atoms, a benzyl group, etc. Preferably, at least one of the three aryl groups is an alkyl-substituted phenyl group in which the alkyl group has 1 to 4 carbon atoms.

Specific examples of the triaryl phosphate include triphenyl phosphate, tricresyl phosphate, benzyldiphenyl phosphate, cresyldiphenyl phosphate, dicresylphenyl phosphate, ethylphenyldiphenyl phosphate, di(ethylphenyl)phenyl phosphate, propylphenyldiphenyl phosphate, di(propylphenyl)phenyl phosphate, trimethylphenyl phosphate, tripropylphenyl phosphate, tert-butylphenyldiphenyl phosphate, di(tert-butylphenyl)phenyl phosphate, tri-tert-butylphenyl phosphate, etc.

The triaryl phosphate is preferably tricresyl phosphate, tert-butylphenyldiphenyl phosphate or di(tert-butylphenyl) phenyl phosphate, and above all, tert-butylphenyldiphenyl phosphate or di(tert-butylphenyl)phenyl phosphate, or a mixture thereof is more preferred.

In this aspect, by using the specific triaryl phosphate, oxidation stability can be further improved without sludge formation.

(Dithiophosphate)

The dithiophosphate is preferably a dithiophosphate having a carboxy group at the terminal thereof. Specific examples of the dithiophosphate having a carboxy group at the terminal thereof include compounds represented by the following general formula (C-1).

(C-1)

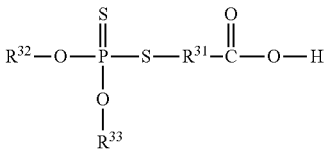

In the formula (C-1), $R^{31}$ represents a linear or branched alkylene group having 1 to 8 carbon atoms, and $R^{32}$ and $R^{33}$ each independently represent a hydrocarbon group having 3 to 20 carbon atoms.

The compound represented by the general formula (C-1) where $R^{31}$ is a linear or branched alkylene group having 1 to 8 carbon atoms can better solubility in a base oil. More preferably, $R^{31}$ is a linear or branched alkylene group having 2 to 4 carbon atoms, and is even more preferably a branched alkylene group.

Preferred specific examples of $R^{31}$ include —$CH_2CH_2$—, —$CH_2CH(CH_3)$—, —$CH_2CH(CH_2CH_3)$—, $CH_2CH(CH_3)CH_2$—, —$CH_2CH(CH_2CH_2CH_3)$—, etc., in which —$CH_2CH(CH_3)$— and —$CH_2CH(CH_3)CH_2$— are more preferred, and —$CH_2CH(CH_3)$— is even more preferred.

$R^{32}$ and $R^{33}$ each are, from the viewpoint of bettering lubricant performance and bettering solubility in base oil, preferably a linear or branched alkyl group having 3 to 8 carbon atoms, more preferably a linear or branched alkyl group having 4 to 6 carbon atoms. Specifically, these are preferably selected from propyl, isopropyl, butyl, isobutyl, t-butyl, pentyl, isopentyl, hexyl, 2-ethylbutyl, 1-methylpentyl, 1,3-dimethylbutyl and 2-ethylhexyl, and among these, isobutyl and t-butyl are more preferred.

In this aspect, from the viewpoint of bettering lubricant performance, using a dithiophosphate is preferred.

(Phosphate Amine Salt)

The phosphate amine salt includes acid phosphate amine salts and acid phosphite amine salts, and among these, acid phosphate amine salts are preferred.

Acid phosphate amine salts are salts of acid phosphates and amines. The acid phosphates usable here include mono or di-alkyl acid phosphates where the alkyl group has 1 to 18 carbon atoms, preferably 1 to 12 carbon atoms, such as monomethyl acid phosphate, dimethyl acid phosphate, monoethyl acid phosphate, diethyl acid phosphate, monopropyl acid phosphate, dipropyl acid phosphate, monobutyl acid phosphate, dibutyl acid phosphate, mono-2-ethylhexyl acid phosphate, di-2-ethylhexyl acid phosphate, monodecyl acid phosphate, didecyl acid phosphate, monolauryl acid phosphate, dilauroyl acid phosphate, monotridecyl acid phosphate, ditridecyl acid phosphate, monomyristyl acid phosphate, dimyristyl acid phosphate, monopalmityl acid phosphate, dipalmityl acid phosphate, monostearyl acid phosphate, distearyl acid phosphate, etc.; or mixtures thereof.

The amines may be any of primary amines, secondary amines and tertiary amines, but primary amines are preferred. The amines are represented by a general formula $NR_3$, in which, preferably, 1 to 3 of R's each are a hydrocarbon group, and the remainder is a hydrogen atom. Here, the hydrocarbon group is preferably an alkyl group or an alkenyl group, and may be linear, branched or cyclic, but is preferably linear or branched. Also preferably, the hydrocarbon group has 6 to 20 carbon atoms, more preferably 8 to 20 carbon atoms.

Here, examples of the primary amine include cyclohexylamine, n-hexylamine, n-octylamine, laurylamine, n-tridecylamine, myristylamine, stearylamine, or structural isomers thereof in which the alkyl group has a branched structure, or oleylamine, etc. Examples of the secondary amine include dicyclohexylamine, di-n-hexylamine, di-n-octylamine, dilaurylamine, dimyristylamine, distearylamine, or structural isomers thereof in which the alkyl group has a branched structure, or dioleylamine, etc. Examples of the tertiary amine include tricyclohexylamine, tri-n-hexylamine, tri-n-octylamine, trilaurylamine, trimyristylamine, tristearylamine, or structural isomers thereof in which the alkyl group has a branched structure, or trioleylamine, etc.

As the phosphorus-containing extreme pressure agent (C), among the above, from the viewpoint of more enhancing lubricant performance and oxidation stability, using at least one selected from tert-butylphenyldiphenyl phosphate, di(tert-butylphenyl)phenyl phosphate, a dithiophosphate having a carboxy group at the terminal, and acid phosphate amine salt is more preferred.

Phosphate amine salts are preferred as readily realizing the above-mentioned effect by using a small amount thereof. In the case where a phosphate amine salt is used, the content of the phosphate amine salt is preferably 0.005 to 0.2% by mass based on the total amount of the lubricating oil composition, more preferably 0.01 to 0.1% by mass, even more preferably 0.01 to 0.08% by mass. The content falling within the range more readily improves oxidation stability and wear resistance without any specific sludge increase.

On the other hand, in the case where any other phosphorus-containing extreme pressure agent (C) than phosphate amine salts (that is, triaryl phosphate, dithiophosphate) is used, the phosphorus-containing extreme pressure agent (C) of the type is preferably contained in an amount of 0.03 to 1.5% by mass based on the total amount of the lubricating oil composition, more preferably 0.05 to 1.0% by mass, even more preferably 0.1 to 0.8% by mass. The content falling within the range more readily improves oxidation stability and wear resistance without any specific sludge increase.

[Succinate Compound (D)]

The lubricating oil composition may further contain a succinate compound (D). Specifically, the succinate compound (D) includes an alkenylsuccinic acid polyhydric alcohol ester. The alkenylsuccinic acid polyhydric alcohol ester is an ester of an alkenylsuccinic acid and a polyhydric alcohol, and is preferably a half ester where one carboxy group in the succinic acid has remained as such.

Examples of the alkenyl group in the alkenylsuccinic acid include those having 12 to 20 carbon atoms such as dodecenyl, hexadecenyl, octadecenyl, isooctadecenyl, etc. Examples of the polyhydric alcohol include saturated dialcohols having 1 to 6 carbon atoms such as ethylene glycol, propylene glycol, butylene glycol, hexylene glycol, and structural isomers thereof, and in addition thereto, tri- or more saturated polyhydric alcohols such as trimethylolpropane, trimethylolbutane, glycerin, pentaerythritol, dipentaerythritol, etc. Among these, use of saturated dialcohols having 3 or 4 carbon atoms, that is, propylene glycol and butylene glycol, or structural isomers thereof, as well as trimethylolpropane, glycerin and pentaerythritol is preferred.

Containing the succinate compound (D), the lubricating oil composition of this aspect may further better rust-preventive performance and oxidation stability.

Preferably, the succinate compound (D) is contained in an amount of 0.01 to 0.3% by mass based on the total amount of the lubricating oil composition, more preferably 0.01 to 0.2% by mass, even more preferably 0.02 to 0.1% by mass.

[Amine-Based Antioxidant (E)]

The lubricating oil composition may further contain an amine-based antioxidant (E). The amine-based antioxidant (E) usable in this aspect includes, though not specifically limited thereto, compounds represented by the following general formula (E-1):

$$Ar^1—NH—Ar^2 \quad \text{(E-1)}$$

wherein $Ar^1$ and $Ar^2$ each independently represent an aryl group having 6 to 24 carbon atoms selected from a phenyl group, an alkyl-substituted phenyl group substituted with an alkyl group, an aralkyl-substituted phenyl group substituted with an aralkyl group, a naphthyl group, and an alkyl-substituted naphthyl group substituted with an alkyl group.

More specifically, the amine-based antioxidant (E) is preferably at least one selected from phenyl-α-naphthylamines represented by the following general formula (E-2) and diphenylamines represented by the following general formula (E-3):

(E-2)

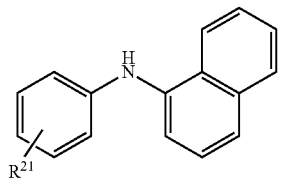

wherein $R^{21}$ represents a hydrogen atom, or an alkyl group having 1 to 18 carbon atoms; and (E-3)

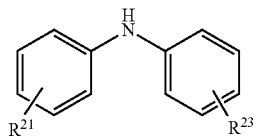

wherein $R^{22}$ and $R^{23}$ each are independently selected from a hydrogen atom, an alkyl group having 1 to 18 carbon atoms, and an aralkyl group having 7 to 18 carbon atoms.

In the phenyl-α-naphthylamines represented by the general formula (E-2), $R^{21}$ is preferably a hydrogen atom or an alkyl group having 1 to 12 carbon atoms, and $R^{21}$ is preferably at the para-position.

In the diphenylamines represented by the general formula (E-3), preferably, $R^{22}$ and $R^{23}$ each are independently selected from a hydrogen atom, an alkyl group having 4 to 12 carbon atoms, and an α,α-dimethylbenzyl group. Preferably, these are positioned both in the para-position.

Specific examples of the amine-based antioxidant include, though not specifically limited thereto, dioctyldiphenylamine, phenyl-α-naphthylamine, diphenylamine, dinonyldiphenylamine, monobutylphenylmonooctylphenylamine, p-t-octylphenyl-1-naphthylamine, 4,4'-bis(α,α-dimethylbenzyl)diphenylamine, etc.

As the amine-based antioxidant (E), any other diamine-based compounds than the above are also usable. Specific examples thereof include N-isopropyl-N'-phenyl-p-phenylenediamine, N-(1,3-dimethylbutyl)-N'-phenyl-p-phenylenediamine, N,N'-di-2-naphthyl-p-phenylenediamine, N-phenyl-N'-(1,3-dimethylbutyl)-p-phenylenediamine. These diamine compounds may be used either singly or as combined with the above-mentioned compound represented by the general formula (E-1).

In this aspect, when the lubricating oil composition contains the amine-based antioxidant (E), its oxidation stability can be bettered more. Preferably, the amine-based antioxidant (E) is contained in an amount of 0.02 to 1.0% by mass based on the total amount of the lubricating oil composition, more preferably 0.03 to 0.5% by mass, even more preferably 0.05 to 0.3% by mass. When the content is the above-mentioned lower limit or more, oxidation stability can be bettered more. When the content is the above-mentioned upper limit or less, the composition can readily exhibit the advantageous effects thereof corresponding to the added amount of the component while suppressing sludge formation.

The lubricating oil composition of this aspect may contain any other additive than the above-mentioned additives within a range not detracting from the object of the present invention. Such additives include known additives such as a metal detergent, an ash-free dispersant, a friction modifier, a viscosity index improver, a pour point depressant, a defoaming agent, a rust inhibitor, a metal inactivator, etc.

Preferably, the lubricating oil composition has a kinematic viscosity at 40° C. of 10 to 4,000 $mm^2/s$, more preferably 20 to 500 $mm^2/s$.

The lubricating oil composition of this aspect is usable for turbine oils for use for lubrication of various turbines such as steam turbines, nuclear turbines, gas turbines, turbines for hydraulic power generation, etc.; bearing oils, gear oils and hydraulic oils for control systems that are for lubrication of various turbo machines such as blowers, compressors, etc.; and further hydraulic actuation oils, lubricating oils for internal combustion engines, etc. Among these, lubricating oils for rotary appliances and hydraulic actuation oils that are for use for lubrication of rotary appliances such as turbines, blowers, compressors and others are preferred.

A production method for the lubricating oil composition in this aspect is a method including blending a base oil with 2,6-di-tert-butylphenol (A) and at least one compound (B) selected from a benzotriazole compound and a sorbitan compound to obtain a lubricating oil composition. Here, the details and the amount to be blended of the base oil, and the compounds (A) and (B) are as mentioned above, and therefore description thereof is omitted.

In the production method, any other additives than the compounds (A) and (B) mentioned above may also be blended in the base oil. The details and the amount to be blended thereof are as mentioned above, and therefore description thereof is omitted.

EXAMPLES

Hereinunder the present invention is described more specifically with reference to Examples, but the present invention is not whatsoever restricted by these Examples.

The measured values of physical properties and the evaluation methods for them in this description are as mentioned below.

[Kinematic Viscosity]

Measured according to JIS K2283.

[Lubrication Performance (Falex Test)]

Using a Falex test machine, pre-conditioning interim operation was carried out at room temperature (25° C.) and under the condition of 1334 N, 5 minutes and 290 rpm, and then under the condition of continuous loading of 40 N/sec, the load until seizing was determined.

[RPVOT Value (Rotating Pressure Vessel Oxidation Test)]

Based on JIS K2514, under the condition of 150° C., the time it takes for the vessel pressure to lower by 175 kPa from the maximum pressure before the start of test was counted.

[Oxidation Stability Test]

According to the method described in ASTM D7873, an oxidation degradation test was carried out, and after 480 hours, the amount of sludge formation and the RPVOT value (JIS K2514) were determined. The RPVOT value was evaluated as the ratio to the initial RPVOT value (new oil) (RPVOT residual ratio). The measurement method for the RPVOT value is as described above. The measurement method for the amount of sludge formation is as follows.

[Amount of Sludge Formation]

According to the method described in ASTM D7873-13, the amount was measured using a membrane filter having a mean pore size of 1.0 μm by Millipore Corporation.

Examples 1 to 5, Comparative Examples 1 to 2

A lubricating oil composition was prepared according to the formulation shown in Table 1, and the resultant lubricating oil composition was evaluated. The results are shown in Table 1.

Base oil (2): paraffinic mineral oil, VG100-equivalent high-degree hydrogenation (Group II)

Phenol-based antioxidant (1): 2,6-di-tert-butylphenol

Benzotriazole compound: compound represented by the following chemical formula:

[Chem. 6]

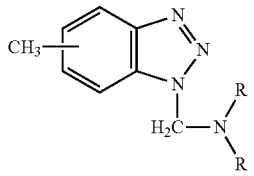

In the above chemical formula, every R is a 2-ethylhexyl group.

Sorbitan compound: sorbitan monooleate

Phosphorus-containing extreme pressure agent (1): tricresyl phosphate

Phosphorus-containing extreme pressure agent (2): mixture of tert-butylphenyldiphenyl phosphate and di(tert-butylphenyl)phenyl phosphate Phosphorus-containing extreme pressure agent (3): salt of mixture of monomethyl acid phosphate and dimethyl acid phosphate and alkylamine (where the alkyl group of the alkylamine is a mixture of a branched alkyl group having 12 to 14 carbon atoms)

Alkenylsuccinic acid polyhydric alcohol ester: mixture of 66.5% by mass of half ester, 5.5% by mass of dibasic acid ester, and 28% by mass of mineral oil Amine-based antioxidant: p-t-octylphenyl-α-naphthylamine Defoaming agent: 1% silicone compound diluted with light oil

TABLE 1

| | | Example 1 | Example 2 | Example 3 | Example 4 | Example 5 | Comparative Example 1 | Comparative Example 2 |
|---|---|---|---|---|---|---|---|---|
| Base Oil (1) | wt % | 93.62 | 92.97 | 93.36 | 92.91 | 93.01 | 93.58 | 93.20 |
| Base Oil (2) | wt % | 5.93 | 5.88 | 5.92 | 5.89 | 5.89 | 5.77 | 5.75 |
| Phenol-based Antioxidant (1) | wt % | 0.30 | 0.50 | 0.50 | 0.50 | 0.50 | 0.50 | 0.50 |
| Benzotriazole Compound | wt % | 0.05 | 0.10 | 0.05 | 0.05 | | | |
| Sorbitan Compound | wt % | | | | | 0.05 | | |
| Phosphorus-Containing Extreme Pressure Agent (1) | wt % | | 0.40 | | | 0.40 | | 0.40 |
| Phosphorus-Containing Extreme Pressure Agent (2) | wt % | | | | 0.40 | | | |
| Phosphorus-Containing Extreme Pressure Agent (3) | wt % | | | 0.02 | | | | |
| Alkenylsuccinic Acid Polyhydric Alcohol Ester | wt % | | 0.05 | 0.05 | 0.05 | 0.05 | 0.05 | 0.05 |
| Amine-Based Antioxidant | wt % | | | | 0.10 | | | |
| Defoaming Agent | wt % | 0.10 | 0.10 | 0.10 | 0.10 | 0.10 | 0.10 | 0.10 |
| Total | wt % | 100.00 | 100.00 | 100.00 | 100.00 | 100.00 | 100.00 | 100.00 |
| B/A | | 0.17 | 0.20 | 0.10 | 0.10 | 0.10 | 0.00 | 0.00 |
| Kinematic Viscosity (40° C.) | $mm^2/s$ | 32.62 | 32.64 | 32.57 | 32.68 | 32.60 | — | — |
| Falex Test | N | 2750 | 2950 | 4490 | 3040 | 3120 | 2690 | 2890 |
| RPVOT (initial) | min | 684 | 875 | 960 | 869 | 606 | 312 | 435 |
| Oxidation Stability Dry-TOST (120° C., 480 hrs) | | | | | | | | |
| Amount of Sludge Formation (1.0 μm) | mg/100 mL | 0.2 | 0.3 | 4.8 | 4.8 | 0.4 | 4.5 | 6.7 |
| RPVOT Residual Ratio | % | 47.2 | 50.2 | 55.2 | 40.9 | 49.9 | 26.2 | 23.5 |

Details of the components in Table 1 are as follows.

Base oil (1): paraffinic mineral oil, VG30-equivalent high-degree hydrogenation (Group II)

As described above, the lubricating oil compositions of Examples 1 to 5 contained 2,6-di-tert-butylphenol, and a benzotriazole compound or a sorbitan compound, and therefore had a high PRVOT value and a high PRVOT residual ratio without forming a large amount of sludge in the oxidation stability test, that is, these compositions were excellent in oxidation stability. In addition, the lubrication performance thereof was also good. On the other hand, the lubricating oil compositions of Comparative Example 1 and Comparative Example 2 did not contain a benzotriazole compound or a sorbitan compound, and therefore the PRVOT value and the PRVOT residual ratio thereof were low, that is, the oxidation stability thereof was not good.

Examples 6 to 8

Using the mineral oil of Group III as the base oil, a lubricating oil composition was prepared according to the formulation shown in Table 2, and the resultant lubricating oil composition was evaluated. The results are shown in Table 2.

TABLE 2

| | | Example 6 | Example 7 | Example 8 |
|---|---|---|---|---|
| Base Oil (3) | wt % | 98.85 | 99.10 | 98.40 |
| Phenol-based Antioxidant (1) | wt % | 0.50 | 0.50 | 0.50 |
| Phenol-based Antioxidant (2) | wt % | | | 0.50 |
| Benzotriazole Compound | wt % | 0.05 | 0.05 | 0.05 |
| Phosphorus-Containing Extreme Pressure Agent (2) | wt % | 0.45 | | 0.40 |
| Phosphorus-Containing Extreme Pressure Agent (4) | wt % | | 0.20 | |
| Alkenylsuccinic Acid Polyhydric Alcohol Ester | wt % | 0.05 | 0.05 | 0.05 |
| Defoaming Agent | wt % | 0.10 | 0.10 | 0.10 |
| Total | wt % | 100.00 | 100.00 | 100.00 |
| B/A | | 0.10 | 0.10 | 0.10 |
| Kinematic Viscosity (40° C.) | $mm^2/s$ | 34.71 | 32.69 | 33.93 |
| Falex Test | N | 3420 | 5260 | 3040 |
| RPVOT (initial) | min | 1104 | 727 | 954 |
| Oxidation Stability Dry-TOST (120° C., 480 hrs) | | | | |
| Amount of Sludge Formation (1.0 μm) | mg/100 mL | 0.1 | 3.7 | 0.1 |
| RPVOT Residual Ratio | % | 55.4 | 40.1 | 58.2 |

The base oil (3), the phenol-based antioxidant (2) and the phosphorus-containing extreme pressure agent (4) in Table 2 are as mentioned below, and the others are the same as mentioned above.

Base oil (3): paraffinic mineral oil, VG30-equivalent high-degree hydrogenation (Group III)

Phenol-based antioxidant (2): compound represented by the following formula:

[Chem. 7]

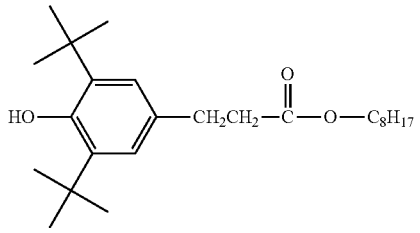

Phosphorus-containing extreme pressure agent (4): dithiophosphate represented by the following formula:

[Chem. 8]

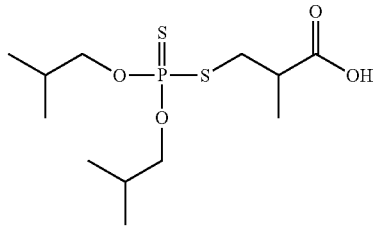

As described above, the lubricating oil compositions of Examples 6 to 8 contained 2,6-di-tert-butylphenol and a benzotriazole compound, and therefore had a high PRVOT value and a high PRVOT residual ratio without forming a large amount of sludge in the oxidation stability test, that is, these compositions were excellent in oxidation stability. In Examples 6 to 8, the Group III base oil was used as a base oil, and therefore the PRVOT value and the PRVOT residual ratio of the compositions were readily high.

The invention claimed is:

1. A lubricating oil composition, consisting of:

at least one base oil;

a 2,6-di-tert-butylphenol (A) and optionally at least one other phenol-based antioxidant;

a sorbitan compound (B);

optionally at least one benzotriazole compound;

at least one phosphorus-containing extreme pressure agent (C);

optionally at least one succinate compound (D);

optionally at least one amine-based antioxidant (E); and optionally at least one additive selected from the group consisting of an ash-free dispersant, a viscosity index improver, a pour point depressant, a defoaming agent, a rust inhibitor, a metal inactivator and mixtures thereof, wherein:

the lubricating oil composition has a kinematic viscosity at 40° C. of 20 to 500 $mm^2/s$, the lubricating oil composition does not contain a metal detergent; and the at least one base oil includes at least one mineral oil which is grouped in Group 2 or 3 in the base oil category of API (American Petroleum Institute) as a major amount of the at least one base oil;

a content of the base oil is 80 to 99.7% by mass, based on the total amount of the lubricating oil composition;

a content of the 2,6-di-tert-butylphenol (A) is 0.2 to 1.0% by mass, based on a total amount of the lubricating oil composition;

a content of the sorbitan compound (B) is 0.02 to 0.2% by mass, based on the total amount of the lubricating oil composition;

the sorbitan compound (B) includes at least a sorbitan monooleate (B1); and the ratio by mass of the sorbitan monooleate (B1) to the 2,6-di-tert-butylphenol (A) (B1/A) is from 0.005 to 0.3;

the phosphorus-containing extreme pressure agent (C) is at least one selected from the group consisting of a triaryl phosphate, a dithiophosphate and a phosphate amine salt;

when the phosphorus-containing extreme pressure agent (C) is a phosphate amine salt, a content of the phosphate amine salt is 0.01 to 0.08% by mass, based on the total amount of the lubricating oil composition;

when the phosphorus-containing extreme pressure agent (C) is at least one of a triaryl phosphate and a dithiophosphate, a content of the phosphorus-containing extreme pressure agent (C) is 0.1 to 1.5% by mass, based on the total amount of the lubricating oil composition;

when the lubricating oil composition is tested with a Falex test machine, where a pre-conditioning interim operation is carried out at 1334 N and 290 rpm for 5 minutes, and then under continuous loading of 40 N/sec at 25° C., the load until seizing is 3120 N or more;

when a rotating pressure vessel oxidation test based on JIS K2514 is performed on the lubricating oil composition at 150° C., the time (RPVOT Value) is takes for the vessel pressure to lower by 175 kPA from the maximum pressure before the start of the test is 606 minutes or more;

when the lubricating oil composition is tested according to the method described in ASTM D7873-13, the amount of sludge formation measured using a membrane filter having a mean pore size of 1.0 μm after 480 hours is 0.4 mg/100mL or less.

2. The lubricating oil composition according to claim 1, wherein a ratio by mass of sorbitan monooleate (B1) to the 2,6-di-tert-butylphenol (A) (B1/A) is from 0.020 to 0.250.

3. The lubricating oil composition according to claim 1, wherein the sorbitan compound (B) further includes a sorbitan fatty acid partial ester in which the fatty acid has 10 to 22 carbon atoms.

4. The lubricating oil composition according to claim 1, wherein the lubricating oil composition includes an alkyl-3-(3,5-di-t-butyl-4-hydroxyphenyl)propionate, in which the alkyl has 4 to 20 carbon atoms, as the other phenol-based antioxidant.

5. The lubricating oil composition according to claim 1, wherein the phosphorus-containing extreme pressure agent (C) is the triaryl phosphate which is at least one selected from the group consisting of tert-butylphenyldiphenyl phosphate and di(tert-butylphenyl)phenyl phosphate.

6. The lubricating oil composition according to claim 1, which includes the at least one amine-based antioxidant (E).

7. The lubricating oil composition according to claim 6, wherein the amine-based antioxidant (E) is a compound represented by formula (E-1):

$$Ar^1—NH—Ar^2 \quad \text{(E-1)}$$

wherein $Ar^1$ and $Ar^2$ each independently represent an aryl group having 6 to 24 carbon atoms selected from the group consisting of a phenyl group, an alkyl-substituted phenyl group substituted with an alkyl group, a naphthyl group, an alkyl-substituted naphthyl group substituted with an alkyl group, and an aralkyl-substituted phenyl group substituted with an aralkyl group.

8. The lubricating oil composition according to claim 6, wherein the amine-based antioxidant (E) is at least one phenyl-α-naphthylamine represented by formula (E-2):

(E-2)

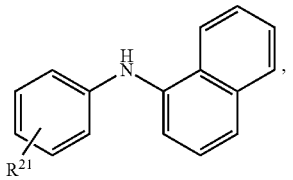

wherein $R^{21}$ represents a hydrogen atom, or an alkyl group having 1 to 18 carbon atoms.

9. The lubricating oil composition according to claim 6, wherein the amine-based antioxidant (E) is contained in an amount of 0.02 to 1.0% by mass based on the total amount of the composition.

10. The lubricating oil composition according to claim 1, which is a lubricating oil for rotary appliances, or a hydraulic actuation oil.

11. A method for producing a lubricating oil composition, the method consisting of blending at least one base oil with a mixture consisting of:

a 2,6-di-tert-butylphenol (A) and optionally at least one other phenol-based antioxidant;

a sorbitan compound (B);

optionally at least one benzotriazole compound;

at least one phosphorus-containing extreme pressure agent (C); and optionally at least one succinate compound (D)

optionally at least one amine-based antioxidant (E); and optionally at least one additive selected from the group consisting of an ash-free dispersant, a viscosity index improver, a pour point depressant, a defoaming agent, a rust inhibitor, a metal inactivator and mixtures thereof, to obtain the lubricating oil composition, wherein:

the lubricating oil composition has a kinematic viscosity at 40° C. of 20 to 500 $mm^2/s$, the lubricating oil composition does not contain a metal detergent; and the at least one base oil includes at least one mineral oil which is grouped in Group 2 or 3 in the base oil category of API (American Petroleum Institute) as a major amount of the at least one base oil;

a content of the base oil is 80 to 99.7% by mass, based on the total amount of the lubricating oil composition;

a content of the 2,6-di-tert-butylphenol (A) is 0.2 to 1.0% by mass, based on a total amount of the lubricating oil composition;

a content of the sorbitan compound (B) is 0.02 to 0.2% by mass, based on the total amount of the lubricating oil composition;

the sorbitan compound (B) includes at least a sorbitan monooleate (B1); and the ratio by mass of the sorbitan monooleate (B1) to the 2,6-di-tert-butylphenol (A) (B1/A) is from 0.005 to 0.3;

the phosphorus-containing extreme pressure agent (C) is at least one selected from the group consisting of a triaryl phosphate, a dithiophosphate and a phosphate amine salt;

when the phosphorus-containing extreme pressure agent (C) is a phosphate amine salt, a content of the phosphate amine salt is 0.01 to 0.08% by mass, based on the total amount of the lubricating oil composition;

when the phosphorus-containing extreme pressure agent (C) is at least one of a triaryl phosphate and a dithiophosphate, a content of the phosphorus-containing extreme pressure agent (C) is 0.1 to 1.5% by mass, based on the total amount of the lubricating oil composition;

when the lubricating oil composition is tested with a Falex test machine, where a pre-conditioning interim operation is carried out at 1334 N and 290 rpm for 5 minutes, and then under continuous loading of 40 N/sec at 25° C., the load until seizing is 3120 N or more;

when a rotating pressure vessel oxidation test based on JIS K2514 is performed on the lubricating oil composition at 150° C., the time (RPVOT Value) is takes for the vessel pressure to lower by 175 kPA from the maximum pressure before the start of the test is 606 minutes or more;

when the lubricating oil composition is tested according to the method described in ASTM D7873-13, the amount of sludge formation measured using a membrane filter having a mean pore size of 1.0 μm after 480 hours is 0.4 mg/100mL or less.

12. The lubricating oil composition according to claim 1, wherein when the phosphorus-containing extreme pressure agent (C) is at least one selected from the group consisting of a triaryl phosphate and a dithiophosphate; and a content of the phosphorus-containing extreme pressure agent (C) is 0.1 to 0.8% by mass, based on a total amount of the lubricating oil composition.

* * * * *